United States Patent [19]

Wirtgen

[11] 3,971,594

[45] July 27, 1976

[54] APPARATUS FOR MILLING ROAD SURFACES

[76] Inventor: Reinhard Wirtgen, Hohnerstrasse, 5461 Windhagen uber Linz (Rhine), Germany

[22] Filed: July 9, 1974

[21] Appl. No.: 486,860

[30] Foreign Application Priority Data

July 10, 1973 Germany ..... 2335002
Sept. 6, 1973 Germany ..... 2344877

[52] U.S. Cl. ..... 299/39; 51/176; 280/639

[51] Int. Cl.[2] ..... E01C 23/09

[58] Field of Search ..... 299/39, 41; 51/176; 280/34 R, 43.2, 43.21, 43.22, 80 R

[56] References Cited

UNITED STATES PATENTS

| | | | |
|---|---|---|---|
| 2,311,891 | 2/1943 | Tyson | 299/39 |
| 2,961,251 | 11/1960 | Roberton | 280/43.21 |
| 3,336,623 | 8/1967 | Coates et al. | 280/34 R X |
| 3,347,596 | 10/1967 | Brejcha et al. | 299/41 X |
| 3,511,394 | 5/1970 | Cox | 280/34 R X |
| 3,608,969 | 9/1971 | Fowkes | 299/39 |

*Primary Examiner*—Ernest R. Purser
*Attorney, Agent, or Firm*—Steinberg and Blake

[57] ABSTRACT

An apparatus for milling road surfaces, the apparatus including an elongated milling roller having hard metal cutters and being adapted to be driven around its central horizontal axis. A pair of end supports extend across opposed ends of the roller normal to the axis thereof, these end supports having projections which extend forwardly of the roller. A pair of swivel arms are pivotally connected respectively to these projections for swivelling movement about parallel vertical axes, respectively, and a pair of road-engaging wheels are respectively connected with the swivel arms for swivelling movement therewith by way of a structure capable of adjusting the elevation of the wheels as well as capable of adjusting the orientation thereof, the swivel arms providing for the wheels any one of three positions, namely positions in front of the roller, between the projections of the end supports of the roller, positions respectively extending forwardly of the end supports, and positions respectively situated laterally beyond the supports, with the rollers being capable of orientation so that their axes are parallel to the milling roll axis irrespective of the position of the swivel arms. Suitable releasable locks are provided both for locking the swivel arms in the selected positions thereof as well as for locking the rollers in their oriented positions.

4 Claims, 3 Drawing Figures

APPARATUS FOR MILLING ROAD SURFACES

This invention relates to an apparatus for uniformly milling road surfaces, unequally worn by the use of studded tires, to remove a layer of a certain thickness, for instance a few centimeters.

In German Offenlegungsschrift No. 2,145,497, an apparatus for milling road surfaces has been described comprising a, preferably self-propelled, chassis and a roller, provided with its own drive and fitted with hard-metal cutters, which is horizontally and vertically adjustable in relation to the road surface, while the roller in order to avoid the strong vibrations occurring in the cutting process is provided at each of its two end support mountings with one or more support wheels which rest on the road surface and are vertically adjustable in relation to the mountings.

These support wheels are rigidly connected at each of said two end support mountings relative to their position in relation to the roller either in front of the roller or on either side of the roller. Vertical adjustment of the support wheels is effected by screwed spindles.

This vertical adjustment by screwed spindles, however, has proved to constitute a problem in practical operation where it is frequently necessary to vary the vertical adjustment during the cutting process in order to mill thicker or thinner layers of the road surface, according to given conditions, because screwed spindles can be moved in the course of the milling operation only when using a relatively great force.

It has furthermore been shown in practical operation that although the arrangement of the support wheels on either side of the roller is of great advantage, there are frequently situations where for instance the road surface is to be milled right up to the edge; in such cases the arrangement of the support wheels on either side of the roller has proved to be unsuitable. On the other hand, there are frequently cases where the road surface to be milled is so severely damaged at the locations to be milled that the support wheels mounted in front of the roller and rolling on the severely damaged road surface are unsuitable for obtaining a uniform adjustment of the cutting depth of the roller and will only insufficiently fulfill their task of avoiding vibration in the milling operation. In such a case, support wheels mounted on either side of the cutting roller would be more suitable in order to adjust the cutting depth relative to the less damaged edges of the road surface.

It can be taken from the above that for the various applications, different milling machines have to be used where the support wheels are mounted either in front of the cutting roller or on either side thereof.

In practice, however, this leads to considerable difficulties as the applicability of such a milling device is thereby essentially restricted.

It is, therefore, an object of the present invention to create an apparatus for milling road surfaces which does not show the disadvantages enumerated above and wherein the support wheels can, selectively and without much effort, be mounted in front of the cutting roller as well as on either side of the cutting roller.

The problem of the invention is solved in that the support wheels are each mounted to the end support mountings of the roller via a supporting arm which is rotatable around a vertical axis and can be locked at different angular positions.

The vertical axis is positioned, relative to the use in the direction of movement, in front of the cutting roller at the end support mounting, and by correspondingly turning the supporting arm, the position of the support wheel in front of the cutting roller can be varied within a broad range. The support wheel can also be mounted beside the cutting roller by laterally swivelling it through 90°.

It has proved to be particularly advantageous if the rotatable supporting arm at the end support mounting of the roller can be locked at angular positions staggered at 90° relative to each other. This will, practically seen, lead to three possibilities for the positioning of the support wheel: either directly in front of the cutting roller, or in front of the cutting roller support, or at the side of the cutting roller support.

If the prior art worm gear is used for the vertical adjustment of the support wheels, the support wheels are, as a rule, mounted freely rotatable so that they readjust to the direction of movement even after the swivelling of the supporting arm.

It has shown to be of particular advantage to use vertical adjustment by rack jacks which are particularly remarkable for their simple handling. In accordance with a preferred embodiment of the present invention, the support wheels are therefore provided vertically adjustable with the aid of rack jacks.

Particularly in this case, the support wheels are mounted, together with the vertical adjustment device, in the rotatable supporting arm which can be swivelled around a second vertical axis and locked at certain angular positions.

By this it is made possible that the shift of the support wheels effected by swivelling the supporting arm is again compensated for and that they are arranged again in the direction of movement. In analogy to the shift of the supporting arm which is rotatable around the vertical axis, the support wheels can, in accordance with a particularly advantageous embodiment of the present invention, also be locked in the rotatable supporting arms at angular positions staggered relative to each other at an angle of 90°.

Locking of the rotatable supporting arms at the end support mounting of the cutting roller can be achieved in various ways.

It has shown to be of particular advantage to provide, for locking the rotatable supporting arms at the end support mountings, hole discs and stop pins arranged coaxially and one above the other and connected with the support mounting or the supporting arm, respectively. Of such hole disc pairs mounted one above the other, one of the hole discs is connected with the supporting arm while the other hole disc is connected to the end support mounting of the cutting roller, and by swivelling the mounting through predetermined angular degrees, the holes provided in the hole discs are in alignment so that the pin can be inserted thus effecting locking of the corresponding angular position.

Locking of the swivelling support wheels in the supporting arms can also be effected in various ways. It has also proved advantageous to use a modification wherein, for locking the swivelling support wheels in the supporting arms, hole discs and stop pins are provided coaxially mounted one above the other and connected with the supporting arm or the support wheel, respectively. As in the case of the locking of the rotatable supporting arm at the end support mounting, in this case, too, one of the hole discs is connected with the support wheel, or with the vertical adjustment device of the support wheel, respectively. Instead of one pin, several pins insertable into holes correspondingly aligned can be used as well.

As already mentioned above, the support wheels can, in accordance with an advantageous embodiment, be vertically adjusted with the aid of rack jacks. In this way, the support wheels can easily and very precisely be adjusted also during the milling process.

Rack jacks as mentioned include a winch crank bearing via a reduction gear upon a rack directly connected with the support wheels. By turning the winch crank, a predetermined vertical adjustment of the support wheels may in view of the relatively great reduction easily be effected.

In accordance with a particularly advantageous modification of the present invention, the reduction gear of the rack jack is so designed that one turn of the winch crank causes a vertical adjustment of the support wheels through 1 millimeter.

Mechanisms indicating the vertical position of the support wheels are therefore no longer needed, it is only necessary to turn the winch cranks a number of turns corresponding to the vertical adjustment in millimeters in order to obtain the desired vertical adjustment.

In accordance with a further development of the present application, the handling of these rack jacks which are arranged on either side of the cutting roller is further simplified in that the winch cranks of the winches which are arranged on each side of the cutting roller are frictionally connected with each other. One operator will be able to make a vertical adjustment of the support wheels thereby adjusting the cutting depth as well.

For such frictional connection any means as might seem appropriate to those versed in the art may be used, such as for instance a shaft provided, if necessary, with a universal coupling, or a so-called flexible shaft.

As it is frequently necessary in the practical operation of the milling apparatus according to the invention to mill the road surface to depths which vary from one side of the cutting roller to the other side, and therefore the support wheels on the one side have to be differently adjusted than the support wheels on the other side of the cutting roller, the winch cranks of the winches, arranged on either side of the cutting roller, are frictionally connected, in accordance with a further advantageous embodiment of the present invention, via a device that can be disconnected if necessary. This disconnectable device is preferably provided in the neighbourhood of the winch crank which is attended to by the operator so that it is possible either to operate both winches at the same time or to use only one of the winches. As such disconnectable device for the frictional connection, any of the current means might be employed which are known to those versed in the art, such as for instance a coupling, a click-stop device, or the like.

Embodiments of the present invention will now be described with reference to the accompanying drawings, wherein FIG. 1 is a side view of a cutting roller mounting having a supporting arm, rotatable around a vertical axis, for the support wheel which is vertically adjustable.

Figure 1:
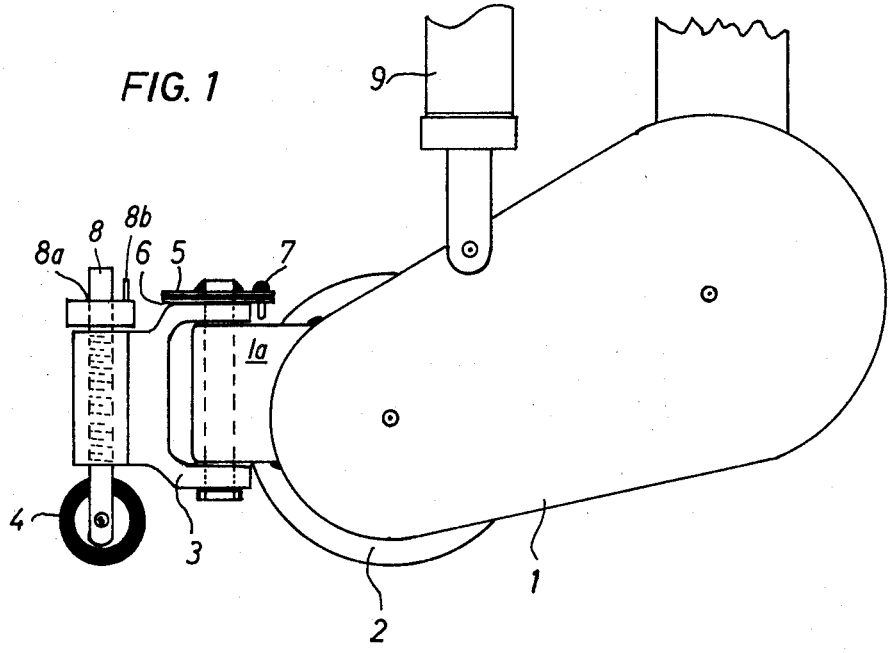

The embodiment of the present invention shown in FIG. 1 comprises, at the end support means 1 for cutting or milling roller 2, a supporting or swivel arm 3 which can be swivelled around a vertical axis for support or road-engaging wheel 4 mounted vertically adjustable, which swivel arm can be locked at certain angular positions to end support means 1 by means of a locking device comprising two hole discs 5, 6 arranged one above the other and bolt 7. Vertical adjustment of the support wheel is effected by means of a jack screw 8. As is apparent from FIG. 1, the end support means 1 has a forward projection 1*a* which extends forwardly of the milling roller 2, and the swivel arm 3 is pivotally connected to the projection 1*a* of the support means 1 for swivelling movement with respect to the projection 1*a* about a vertical axis which is situated forwardly of the milling roller 2, the latter of course having a horizontal axis.

It will be understood that the structure shown in FIG. 1 is duplicated at the opposite end of the milling roller 2 which is not visible in FIG. 1.

The screw 8 is threaded into a vertical internally threaded bore of the swivel arm 3 in the manner illustrated in FIG. 1, and at the top surface of the arm 3 the screw 8 fixedly carries a flange 8*a* formed with a vertical bore through which an elongated pin 8*b* slidably extends. By engaging the pin 8*b* after raising it out of an opening formed in the top surface of the arm 3, it is possible to turn the flange 8*a* together with the screw 8 in order to adjust the elevation of the roller 4, and in addition by terminating the turning movement of the screw 8 when it has a selected angle with respect to the arm 3 it is possible to control the orientation of the wheel 4, the top surface of the arm 3 being provided beneath the flange 8 with a series of openings arranged along a circle to selectively receive the pin 8*b* so that through this structure it is possible to control both the elevation and the orientation of the wheel 4. Thus, the element 8 together with the components 8 *a* and 8*b* form a means for adjusting the elevation and angular orientation of the wheel 4.

Figure 2:
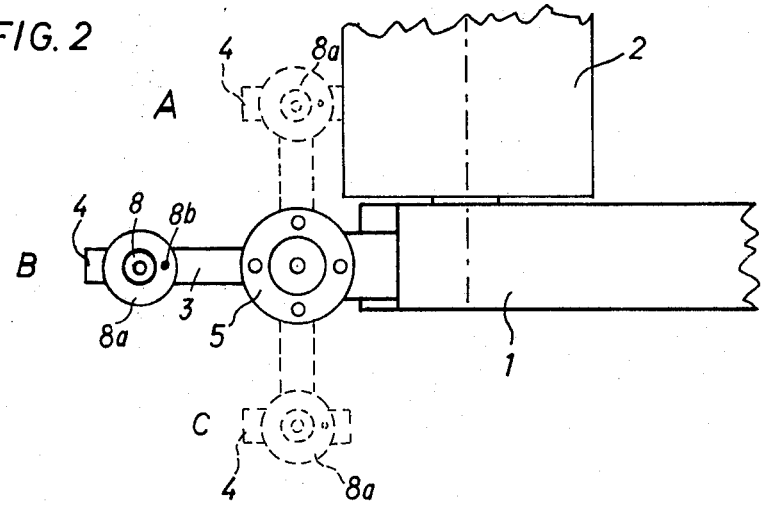
FIG. 2 is a top view on an end support mounting for the cutting roller and the supporting arm which can be swivelled into 3 different angular positions A, B, C for the vertically adjustable support wheel.

FIG. 2 is a top view on end support mounting 1 of cutting roller 2, where at said end support mounting 1 there is provided, rotatably around a vertical axis, the supporting arm 3, which is shown in FIG. 2 in three different angular positions A, B, C.

In position B it will be noted from FIG. 2 that the arm 3 together with the wheel 4 extend forwardly from and are in line with the end support means 1 and its forward projection 1*a*. In position A it will be seen that the wheel 4 is situated in front of the milling roller 2, and of course the same is true of the opposite wheel 4 which is not illustrated, so that in the position A the pair of wheels 4 are both situated in front of the milling roller 2. In position C, which is indicated in dotted lines in FIG. 2 in the same way as position A, it will be seen that the pair of wheels 4 are both situated laterally beyond the pair of projections 1*a*, one of which is shown in FIG. 2. In any of these positions it is of course possible to orient the wheel 4 so that its axis is parallel to the axis of the milling roller 2.

Locking is effected in each selected position with the aid of hole disc 5 which rests on hole disc 6 connected with the swivel arm and whose eccentrically arranged holes are aligned, in said three different angular positions A, B, and C, relative to the holes of hole disc 6 which lies under said disc so that with the aid of bolt 7 locking in said three angular positions can be effected. Thus it will be seen that this structure forms a lock means for releasably locking the swivel arm 3 in a selected one of the three positions A, B, C.

While with the aid of vertically adjustable support wheels 4 the cutting depth relative to the road surface can be adjusted, the hydraulic cylinder 9 provided at the end support mounting of the cutting roller serves for the vertical adjustment of the cutting device relative to the chassis of the milling apparatus.

Figure 3:
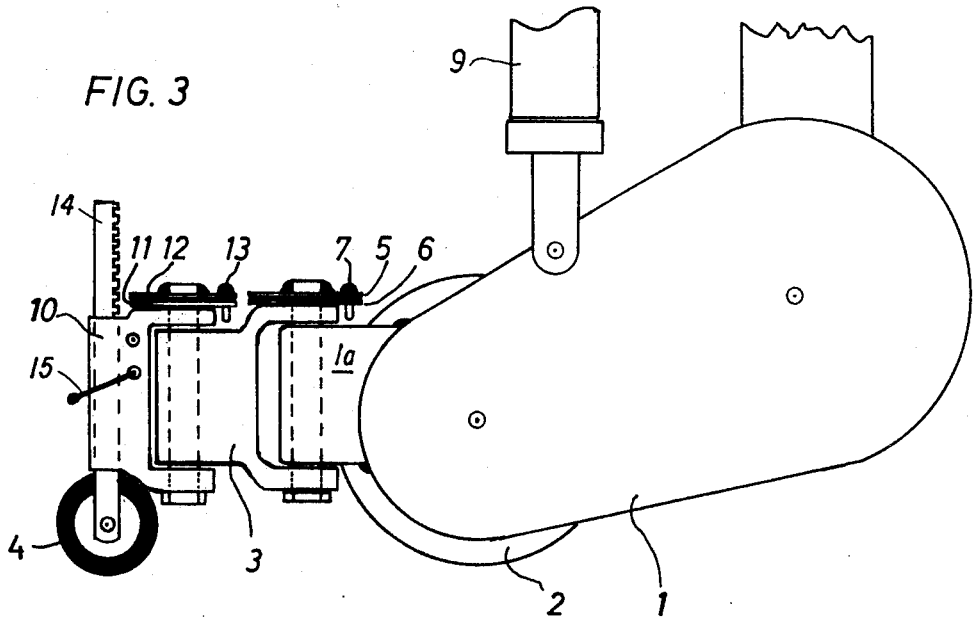
FIG. 3 is a side view of another embodiment of the present invention wherein the support wheel is mounted vertically adjustable via a rack jack and can also be swivelled around, and locked in, a second vertical axis.

In the embodiment of the invention shown in FIG. 3, the support wheel 4 is vertically adjustable via a rack means including rack screw 14 guided for movement in a vertical bore of a second swivel arm 10 and at the same time is connected, swivellingly around a vertical axis, by way of second swivel arm 10 with the first swivel arm 3 which on its part is also mounted swivellingly around a vertical axis to the forward projection 1*a* end support mounting 1 of cutting roller 2. Locking of support wheel 4 at a determined angular position relative to supporting arm 3 is effected in the same way as is the locking of the supporting arm relative to end support mounting 1 by means of a pair of hole discs 11, 12 and a bolt 13 which can be inserted through the eccentrically arranged holes. By swivelling the support wheel, it can either be arranged at the side of end support mounting 1, directly in front of end support mounting 1, or in front of cutting roller 2.

The milling apparatus according to the invention thus complies with all the requirements that may come up in practical operation, and swivelling of the support wheel can be effected in a very simple way. By means of hydraulic cylinder 9, the cutting roller system is lifted, and by loosening bolts 7, or 13, respectively, supporting arm 3 and support wheel 4 can, together with the vertically adjustable system, be swivelled around the vertical axes in question and can then again be locked in the desired positions by inserting bolts 7 and 13.

In FIG. 3 the turns of winch crank 15 are transferred via a corresponding reduction gear to rack jack 14 at whose lower end support wheel 4 is mounted.

The rotation axis of winch crank 15 is, if necessary, frictionally connected with the winch crank of the rack jack provided on the other side of the cutting roller so that by merely turning one winch crank the supporting wheels can vertically be adjusted on both sides of the cutting roller. As has been indicated above, the structure is so designed that one turn of the winch crank 15 will provide a vertical displacement of 1 millimeter at the wheel 4, so that by counting the number of turns of the winch crank 15 it is possible to determine the extent to which the elevation of the wheel 4 has been changed.

Instead of only one single support wheel, support wheel pairs can be provided at swivelling arm 3, too. Moreover, it is also possible to use, instead of a single support wheel, a plurality of support wheels provided on a separate chassis which are less sensible to surface unevenness and thus make possible to more uniformly follow a constant cutting depth independently from surface unevenness and road damages.

What is claimed is:

1. In an apparatus for milling road surfaces, an elongated milling roller provided with hard metal cutters and having a central horizontal axis around which said roller is adapted to be driven, said roller having opposed ends extending across said axis, a pair of end support means respectively situated next to said opposed ends of said roller for supporting the latter for rotation about said horizontal axis, said pair of end support means respectively having projections both of which extend forwardly beyond said roller, a pair of swivel arms respectively connected pivotally to said projections for swivelling movement with respect thereto about parallel vertical axes, respectively, a pair of road-engaging wheels, and adjusting means connecting said wheels respectively to said swivel arms at portions thereof distant from said projections for adjustment in elevation with respect to said swivel arms and for orientation in a direction where the axis of each wheel is parallel to the axis of said roller irrespective of the angular position of each swivel arm with respect to the projection to which it is pivotally connected, said swivel arms cooperating with said projections for situating said wheels in a selected one of three positions, namely positions respectively situated in front of said projections, positions respectively situated between said projections and in front of said roller, and positions respectively situated laterally beyond said projections outside of the space therebetween, and a pair of lock means, one of said lock means cooperating with swivel arms for locking the latter in a selected one of said positions and the other of said lock means cooperating with said adjusting means for locking said wheels in a position oriented with their axes parallel to the axis of said milling roller.

2. The combination of claim 1 and wherein said adjusting means connecting each wheel to each swivel arm for adjustment in elevation and for orientation with its axis parallel to said roller axis includes a vertical screw spindle having a bottom end carrying said wheel, said swivel arm being formed distant from said projection with a bore through which said screw spindle extends, and means connected to said screw spindle for adjusting the elevation thereof together with said wheel with respect to said swivel arm while said screw spindle is turnable about its own vertical axis with respect to said swivel arm for orienting the wheel carried by said screw spindle.

3. The combination of claim 1 and wherein said adjusting means connecting each wheel to each swivel arm for adjustment in elevation and for orientation with its axis parallel to said roller axis includes a second swivel arm pivotally connected to each first-mentioned swivel arm at a part thereof distant from said projection for swivelling movement with respect to each first swivel arm about a vertical axis, and elongated rack means extending vertically in each second swivel arm, having a bottom end carrying each wheel, and being adjustable together with said wheel in elevation with respect to each second swivel arm so that swinging of each second swivel arm with respect to each first-mentioned swivel arm adjusts the orientation of each wheel while said rack means adjusts the elevation thereof, and said other lock means locking each second swivel arm releasably to each first-mentioned swivel arm for maintaining each wheel oriented with its axis parallel to the roller axis irrespective of the selected position for each first-mentioned swivel arm.

4. The combination of claim 3 and wherein said adjusting means includes a winch crank supported for rotary movement by each of said second swivel arms and operatively connected to each elongated rack means for changing the elevation thereof together with the wheel carried thereby by 1 mm for each revolution through which the winch crank is turned.

* * * * *